US012741181B2

(12) United States Patent
Watt

(10) Patent No.: US 12,741,181 B2
(45) Date of Patent: Sep. 22, 2026

(54) GOLF VEHICLE

(71) Applicant: Powakaddy International Limited, Sittingbourne (GB)

(72) Inventor: Matthew Watt, Sittingbourne (GB)

(73) Assignee: Powakaddy International Limited, Sittingbourne (GB)

( * ) Notice: Subject to any disclaimer, the term of this patent is extended or adjusted under 35 U.S.C. 154(b) by 113 days.

(21) Appl. No.: 18/705,658

(22) PCT Filed: Oct. 26, 2022

(86) PCT No.: PCT/GB2022/052722
§ 371 (c)(1),
(2) Date: Apr. 29, 2024

(87) PCT Pub. No.: WO2023/073366
PCT Pub. Date: May 4, 2023

(65) Prior Publication Data

US 2025/0010153 A1 Jan. 9, 2025

(30) Foreign Application Priority Data

Oct. 27, 2021 (GB) ..... 2115466

(51) Int. Cl.
*A63B 55/60* (2015.01)

(52) U.S. Cl.
CPC ..... *A63B 55/60* (2015.10); *A63B 2209/08* (2013.01)

(58) Field of Classification Search
CPC ..... A63B 55/60; A63B 2209/08; B60R 2011/0057; B60R 2011/007
USPC ..... 224/274, 562; 280/DIG. 6; 248/96
See application file for complete search history.

(56) References Cited

U.S. PATENT DOCUMENTS 5,358,109 A * 10/1994 Nichols ..... A63B 55/408 206/315.6
6,305,656 B1 * 10/2001 Wemyss ..... B60R 11/0241 220/628
6,810,774 B2 * 11/2004 Hsien ..... B25B 23/12 81/125
6,932,382 B2 * 8/2005 Hayes ..... B60R 21/01516 324/207.2

(Continued)

FOREIGN PATENT DOCUMENTS

CN 203139549 U 8/2013
CN 205042058 U 2/2016

(Continued)

OTHER PUBLICATIONS

"International Search Report and Written Opinion Received mailed on Feb. 23, 2023", 8 Pages.

(Continued)

*Primary Examiner* — Scott T Mcnurlen
(74) *Attorney, Agent, or Firm* — Billion & Armitage

(57) ABSTRACT

A golf vehicle including a golf bag support; wherein the golf vehicle is selected from a golf trolley and a golf cart; wherein the golf bag support includes a lower support member; wherein the lower support member includes one of an upwardly projecting locating member and a downwardly extending recess defined by a recess body portion; and wherein the upwardly projecting locating member or the recess body portion comprises a ferromagnetic material.

2 Claims, 13 Drawing Sheets

(56) References Cited

U.S. PATENT DOCUMENTS

| | | | | |
|---|---|---|---|---|
| 7,004,482 | B1 | 2/2006 | Steffan | |
| 9,401,239 | B2 * | 7/2016 | Bell | H05K 3/325 |
| 9,442,527 | B2 * | 9/2016 | Schmidt | G06F 1/1632 |
| 11,827,161 | B2 * | 11/2023 | Bachan | F16B 1/00 |
| 2012/0048754 | A1 * | 3/2012 | Niedermeier | A63B 55/00 206/315.3 |
| 2020/0013531 | A1 * | 1/2020 | Tazbaz | H05K 5/0226 |
| 2021/0063108 | A1 * | 3/2021 | Parsons | B60R 7/14 |

FOREIGN PATENT DOCUMENTS

| | | | |
|---|---|---|---|
| EP | 2373386 | A1 | 10/2011 |
| FR | 2989899 | A1 | 11/2013 |
| JP | 2011055968 | A | 3/2011 |
| JP | 2012029955 | A | 2/2012 |

OTHER PUBLICATIONS

"UKIPO Search Report under Section 17 dated Mar. 18, 2022", 2 Pages.

* cited by examiner

GOLF VEHICLE

The present invention relates to a golf vehicle, such as a golf trolley or a golf cart, which includes a golf bag support apparatus.

Golf carts and golf trolleys are designed to carry golf bags. Conventionally, the golf cart/trolley includes a golf bag support apparatus which comprises a base upon which the base of the golf bag is located and a support arm which extends upwards. A lower portion of the golf bag is secured to a lower portion of the golf bag support apparatus by a lower securing apparatus, such as a strap or arm; and an upper portion of the golf bag is secured to an upper portion of the golf bag support apparatus by an upper securing apparatus. It can be time consuming and awkward to secure the golf bag to the golf bag support apparatus using both the upper and the lower securing apparatus. For example, a person has to bend down to secure the bottom of the bag to the lower securing apparatus and this provides difficulties for people who have limited mobility.

In addition, where the golf vehicle is a collapsible golf trolley, the lower securing apparatus can interfere with the collapsing of the trolley, or the design of the trolley is compromised by having to allow for the lower securing apparatus.

Accordingly, it is desired to replace the lower securing apparatus with an alternative arrangement by which a lower portion of the golf bag may be secured to the lower portion of the golf bag support apparatus.

GB2519073 describes a golf trolley in which the lower securing apparatus has been replaced with one or more plug and socket arrangements in which the or each plug forms a snap-fit arrangement with a corresponding socket. The plugs include a waisted portion and are screwed into the bottom of a golf bag. Accordingly, there is a risk that the plug(s) could be broken or become detached from the bag.

The present invention provides an apparatus for securing a golf bag to a golf bag support apparatus which addresses the problems associated with known securing apparatus.

According to a first aspect of the invention, there is provided a golf vehicle including a golf bag support; wherein the golf vehicle is selected from a golf trolley and a golf cart; wherein the golf bag support includes a lower support member; wherein the lower support member includes one of an upwardly projecting locating member and a downwardly extending recess defined by a recess body portion; and wherein the upwardly projecting locating member or the recess body portion comprises a ferromagnetic material or element.

It will be appreciated that the ferromagnetic material/element may be in the form of a permanent magnet or it may be a material that is magnetically attracted to a permanent magnet. The ferromagnetic material/element may be in the form of ferromagnetic plate or a ferromagnetic ring. For example, a ferromagnetic collar which surrounds an aperture or channel.

It will also be appreciated that a golf bag associated with the golf vehicle suitably includes the other of the locating member and the recess, where the locating member is a downwardly projecting locating member and the recess is an upwardly extending recess. In this way, the golf bag support and the golf bag together define a two-part coupling. Thus, if the upwardly projecting locating member of the golf bag support is considered to be a male part of the coupling, then the golf bag may include or define a female part of the coupling, namely an upwardly extending recess. Conversely, if the downwardly extending recess is defined by the recess body portion of the golf bag support is considered to be a female part of the coupling, then the golf bag may include the corresponding male part of the coupling in the form of a downwardly projecting locating member.

In this way, the locating member (male part) may be received within the recess (female part) such that lateral movement of the golf bag relative to the lower support member is prevented or resisted. Furthermore, the locating member or the recess defined by the golf bag may include a second ferromagnetic element, and at least one of the first and second ferromagnetic elements may be a permanent magnet, whereby a magnetic attractive force exists between the golf bag and the lower support member of the golf bag support and disengagement of the locating member from the recess is resisted. In other words, the two-part coupling may be a magnetic coupling.

In an embodiment of the invention, the female part of the two-part coupling may include a ferromagnetic plate. In such embodiments, the ferromagnetic plate may be capable of movement in one or two planes or about one or two axes. Such movement is suitably constrained between a first limit or stop and a second limit or stop. A ferromagnetic plate which is capable of movement in one or two planes permits a better magnetic coupling to be formed, as it ensures a closer arrangement of the ferromagnetic plate of the female part of the coupling relative to the ferromagnetic element of the male part of the two-part coupling. For example, the ferromagnetic plate may be captive within a chamber. The chamber may be in communication with the recess. For example, the recess may open at one end into the chamber. Suitably, the ferromagnetic plate is biased to a first configuration of the plate via a biasing element, such as, for example, a spring. In this way, the insertion of the male part of the coupling into the female part of the coupling urges the ferromagnetic plate from its first configuration to a second configuration against the biasing force. Again, this helps to provide the maximum possible magnetic force between the ferromagnetic materials.

Additionally or alternatively, the male part of the two-part coupling may be carried on a base that is capable of movement about one or two axes (e.g. about a roll axis and/or about a pitch axis). Again, a male part that is capable of movement about one or two axes allows for a better magnetic coupling to be formed. In an embodiment of the invention, the base may include or define a fulcrum or a point about which it can rotate relative to the lower support member.

In an embodiment of the invention, the lower support member includes a downwardly extending recess defined by the recess body portion; wherein the recess is cylindrical in shape or tapers inwards from an upper portion to a lower portion. A tapered recess shape has the effect of guiding a corresponding locating member into the recess. In such embodiments, the recess may include a recess floor portion and the ferromagnetic element may be carried by the recess wall portion and/or the recess floor portion. Thus, the ferromagnetic element may be a disc or a plate of ferromagnetic material and the disc may be carried on an upwardly facing surface of the floor portion, on a downwardly facing surface of the floor portion, or it may be fully or partially embedded within the floor portion. Additionally or alternatively, the ferromagnetic element may be in the form of a ring, collar or loop of a ferromagnetic material which is carried by or embedded (fully or partially) into the side wall of the recess body.

Optionally, the recess body portion may define a recess that is cylindrical, frustoconical or frustopyramidal in shape.

Additionally or alternatively, the lower support member may include an upstanding locating member which tapers from a lower portion to an upper portion. The locating member typically includes a proximal portion which is adjacent to the lower support member and a distal portion which is spaced from the lower support member. In such embodiments, the ferromagnetic element may be carried by the distal portion of the locating member. For example, the ferromagnetic element may be in the form of a disc or plate carried by the distal end portion or it may be in the form of a ring, collar or loop of ferromagnetic material which is located at a peripheral edge of the distal portion.

Optionally, the upstanding locating member may be cylindrical, frustoconical or frustopyramidal in shape.

In an embodiment of the invention, the ferromagnetic element is a permanent magnet. This means that the golf vehicle includes the permanent magnet of the magnetic coupling and the golf bag need only include a ferromagnetic material which is attracted to the permanent magnet. The bottom of a golf bag is more likely to come into contact with ferromagnetic materials. Accordingly, it is more desirable for the permanent magnet to be carried by the golf vehicle. However, providing the golf bag with a permanent magnet is still within the scope of the invention and is not excluded.

In order to supplement the coupling provided by the engagement of the locating member with the corresponding recess, the golf bag support may further include a support arm which extends upwardly from the lower support member. This support arm may be curved or otherwise shaped to correspond to a peripheral shape of a base portion of a golf bag.

According to a second aspect of the invention, there is provided a combination of a golf vehicle as defined anywhere herein in connection with the first aspect of the invention and a golf bag, wherein the golf bag includes a bag base plate; wherein (i) when the lower support member of the golf bag support includes an upwardly projecting locating member which includes a first ferromagnetic element, the bag base plate defines an upwardly extending recess defined by a recess body portion, the recess receives therein the upwardly projecting locating member, and the recess body portion which defines the upwardly extending recess includes a second ferromagnetic element; OR (ii) when the lower support member of the golf bag support includes a downwardly extending recess defined by a recess body portion which includes a first ferromagnetic element, the bag base plate defines a downwardly projecting locating member, the downwardly extending recess receives therein the downwardly projecting locating member, and the downwardly projecting locating member includes a second ferromagnetic element; AND wherein at least one of the first and second ferromagnetic elements is a permanent magnet.

It will be appreciated that in the arrangement according to the second aspect of the invention, the locating member is engaged with the corresponding recess to prevent or to resist lateral movement of the golf bag base plate relative to the lower support member, and the magnetic coupling between the golf bag base plate and the lower support member resists or prevents the disengagement of the locating member from the recess.

The ferromagnetic element carried by the lower support member and/or the golf bag base plate may be in the form of a ferromagnetic disc or plate, or in the form of ferromagnetic ring or loop.

In an embodiment of the second aspect of the invention, the golf bag support includes an upwardly projecting locating member (male part); the golf bag base plate defines an upwardly extending recess (female part) configured to receive therein the upwardly projecting locating member; the upwardly projecting locating member includes a permanent magnet, suitably disposed at a distal end portion of the locating member; and the recess defined by the golf bag base plate includes a ferromagnetic element. In such an arrangement, a two-part magnetic coupling is formed when the locating member is located within the recess.

The locating member is suitably tapered or partially tapered from its base portion (i.e. the portion closest to the golf bag support) to a distal portion.

The ferromagnetic element is suitably a ferromagnetic plate. Additionally, the ferromagnetic plate may be disposed within a chamber located above the recess. The chamber is suitably in communication with the recess, for example, the recess may open at one end into the chamber. The ferromagnetic plate may be displaceable within the chamber. The ferromagnetic plate may be displaced in one or two planes. Thus, it may be displaceable within the chamber in one or two planes. Suitably, the ferromagnetic plate is biased to a first configuration or position, such as, for example, towards the opening of the recess. Thus, the ferromagnetic plate may include a biasing element engaged therewith. In this way, the ferromagnetic plate is urged in use against the permanent magnet carried by the locating member by the biasing element. The displacement of the ferromagnetic plate may be constrained by a chamber body which defines the chamber.

In a further embodiment of the invention, the golf bag support includes an upwardly projecting locating member (male part) and the locating member is carried by a base plate, wherein the base plate is capable of movement about one or two axes (e.g. about a roll axis and/or about a pitch axis). In an embodiment of the invention, the base plate may include or define a fulcrum or a point about which it can rotate relative to the lower support member.

In an alternative embodiment of the second aspect of the invention, the lower support member of the golf bag support includes a downwardly extending recess defined by a recess body portion, the bag base plate defines a downwardly projecting locating member, the downwardly extending recess receives therein the downwardly projecting locating member, the downwardly projecting locating member includes a ferromagnetic element; and wherein a permanent magnet is carried by a portion of the recess body portion which defines the bottom and/or the side wall(s) of the recess.

Suitably, the downwardly projecting locating member includes a proximal portion which is adjacent to the bag base plate, and a distal portion which is spaced from the bag base plate; and the distal portion of the downwardly projecting locating member carries the ferromagnetic element; for example, in the form of a ferromagnetic disc or ferromagnetic ring.

In a further embodiment of the second aspect of the invention, the recess body defines a recess that is frustoconical in shape; and the locating member is frustoconical in shape. The frustoconical locating member suitably corresponds in size and shape with the frustoconical recess, such that the locating member forms a tight fit within the recess.

The skilled person will appreciate that the features described and defined in connection with the aspects of the invention and the embodiments thereof may be combined in any combination, regardless of whether the specific combination is expressly mentioned herein. Thus, all such combinations are considered to be made available to the skilled person.

Embodiments of the invention will now be described, by way of example only, with reference to the accompanying drawings in which:

FIG. 1 shows a perspective view from above of a lower support member of a first embodiment of a golf trolley according to the first aspect of the invention;

FIG. 2*a* shows a bottom view of a golf bag which forms part of a first embodiment of the second aspect of the invention;

FIG. 2*b* shows an enlarged view of the ferromagnetic locating member shown in FIG. 2*a;*

For the avoidance of doubt, the skilled person will appreciate that in this specification, the terms "up", "down", "front", "rear", "upper", "lower", "width", etc. refer to the orientation of the components as found in the example when installed for normal use as shown in the Figures.

Figure 1:
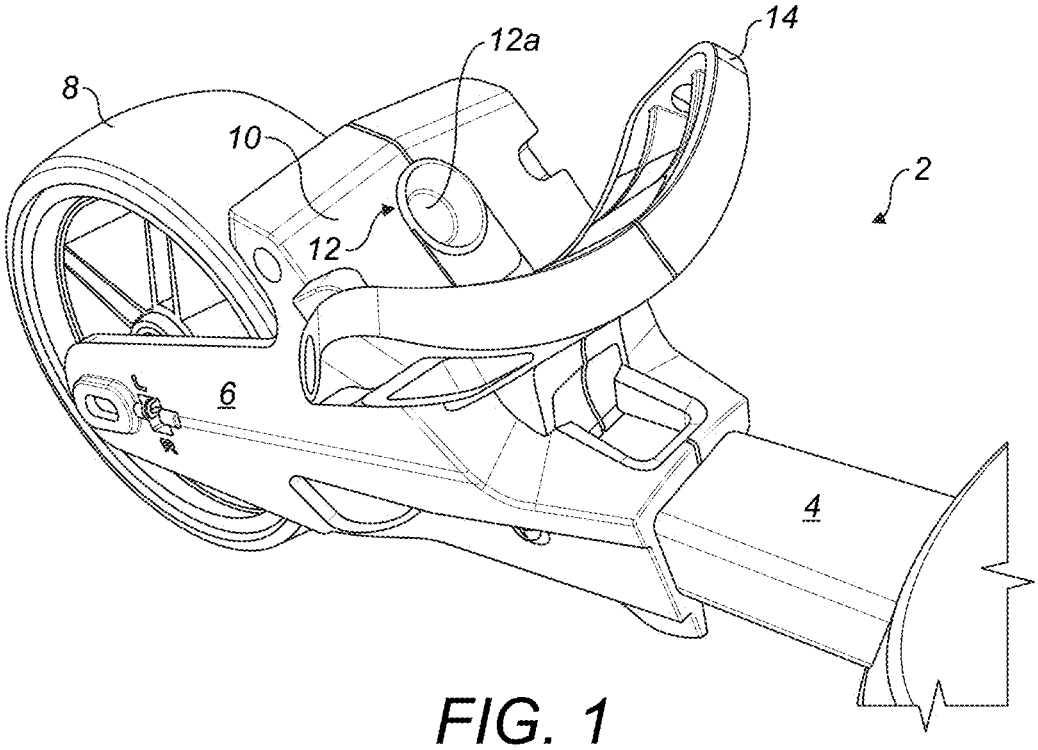

FIG. 1 shows a lower portion 2 of a first embodiment of a golf trolley which in use transports a golf bag around a golf course. The lower portion 2 of the golf trolley includes a front frame arm 4 which supports at its front end a front wheel assembly 6, which in turn rotatably supports a front wheel 8. The front wheel assembly 6 defines a lower support member 10, which is in the form of a substantially rectangular base plate. The lower support member 10 defines in its upwardly facing surface a frustoconical recess 12. The recess 12 includes a substantially planar floor portion 12*a* and a tapered frustoconical wall portion 12*b*. To provide additional support for the bottom of a golf bag 16, a curved support arm 14 extends upwards from the rear of the lower support member 10.

Figure 2A:
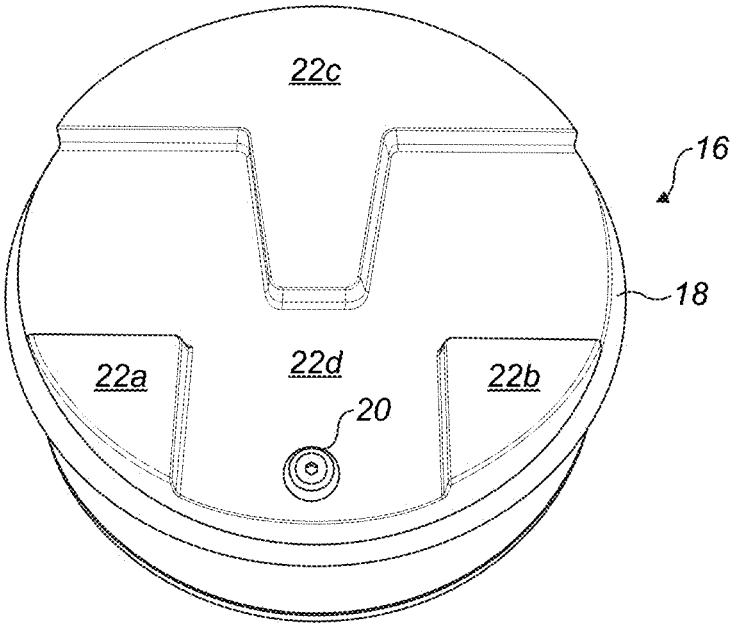
Figure 2B:
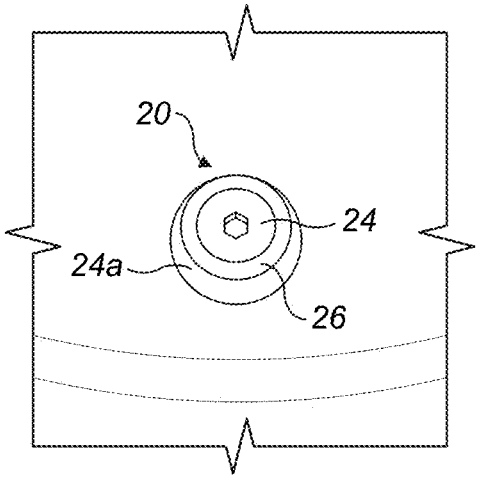

FIGS. 2*a* and 2*b* show a base plate 18 of a golf bag 16. The base plate 18 carries towards a peripheral edge portion thereof a downwardly projecting locating member 20 having a frustoconical body 24*a* which is sized and shaped to be received within the frustoconical recess 12 and to form a tight fit therein. The base plate includes three downwardly projecting feet elements 22*a*, 22*b*, 22*c* which define between them a recessed portion 22*d* of the golf bag base plate 18. The downwardly projecting locating member 20 is located between the feet portions 22*a* and 22*b* and a top surface 24*b* of the locating member 20 does not project beyond a plane defined by the feet portions 22*a*, 22*b* and 22*c*. in this way, the top surface 24*b* does not engage or contact a planar surface when the feet portions 22*a*, 22*b* and 22*c* are supported by the planar surface.

FIG. 2*b* shows the downwardly projecting locating member 20 in more detail. As can be seen from FIG. 2*b*, the top surface 24*b* of the locating member 20 has embedded therein a ferromagnetic steel ring 26.

Figure 3:
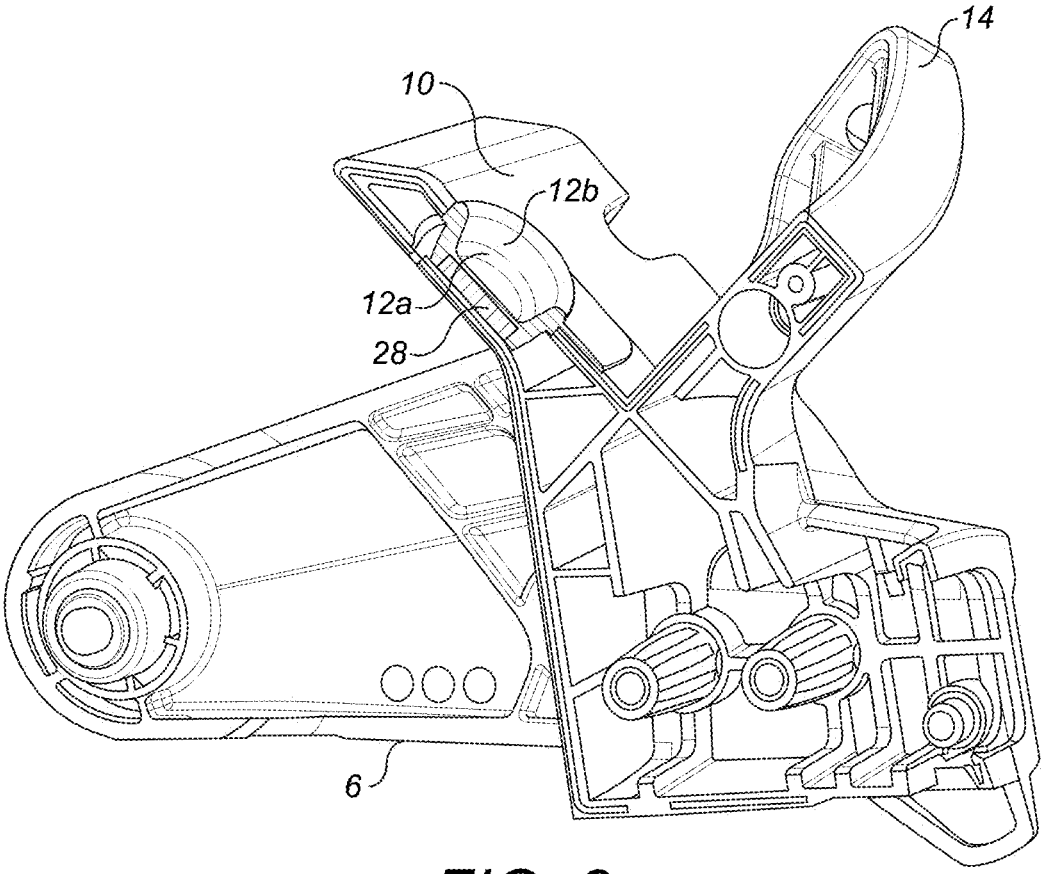
FIG. 3 shows a cross section through the lower support member shown in FIG. 1.

As shown in FIG. 3, the floor portion 12*a* of the frustoconical recess 12 has partially embedded therein a ferromagnetic disc 28 which is in the form of a permanent magnet.

In use, a user places the golf bag 16 on the lower portion 2 of the golf trolley such that the lower support member 10 is located within the recessed portion 22*d* defined between the feet portions 22*a* and 22*b* of the golf bag base plate 18; a side portion of the base plate 18 abuts the curved support arm 14; and the downwardly projecting locating member 20 is disposed within the frustoconical recess 12 with the top surface 24*b* of the locating member 20 being located adjacent to the floor portion 12*a* of the recess 12. In this way, a magnetic coupling is provided between the permanent magnetic disc 28 and the ferromagnetic ring 26.

The interengagement between the locating member 20 and the recess 12, and the lower support member 10 and the feet portions 22*a*, 22*b* prevents lateral displacement of the golf bag base plate 18 relative to the lower support member 10. Furthermore, the magnetic coupling between the permanent magnetic disc 28 and the ferromagnetic ring 26 prevents the unintentional disengagement of the golf bag base plate 18 from the lower support member 10.

When a user wished to remove the golf bag 16 from the golf trolley, he/she simply applies an upward force which is greater that the magnetic force exerted by the permanent magnet 28 on the ferromagnetic steel ring 16. Once the magnetic force has been overcome, the golf bag 16 may be lifted away from the lower portion 2 of the golf trolley.

Figure 4:
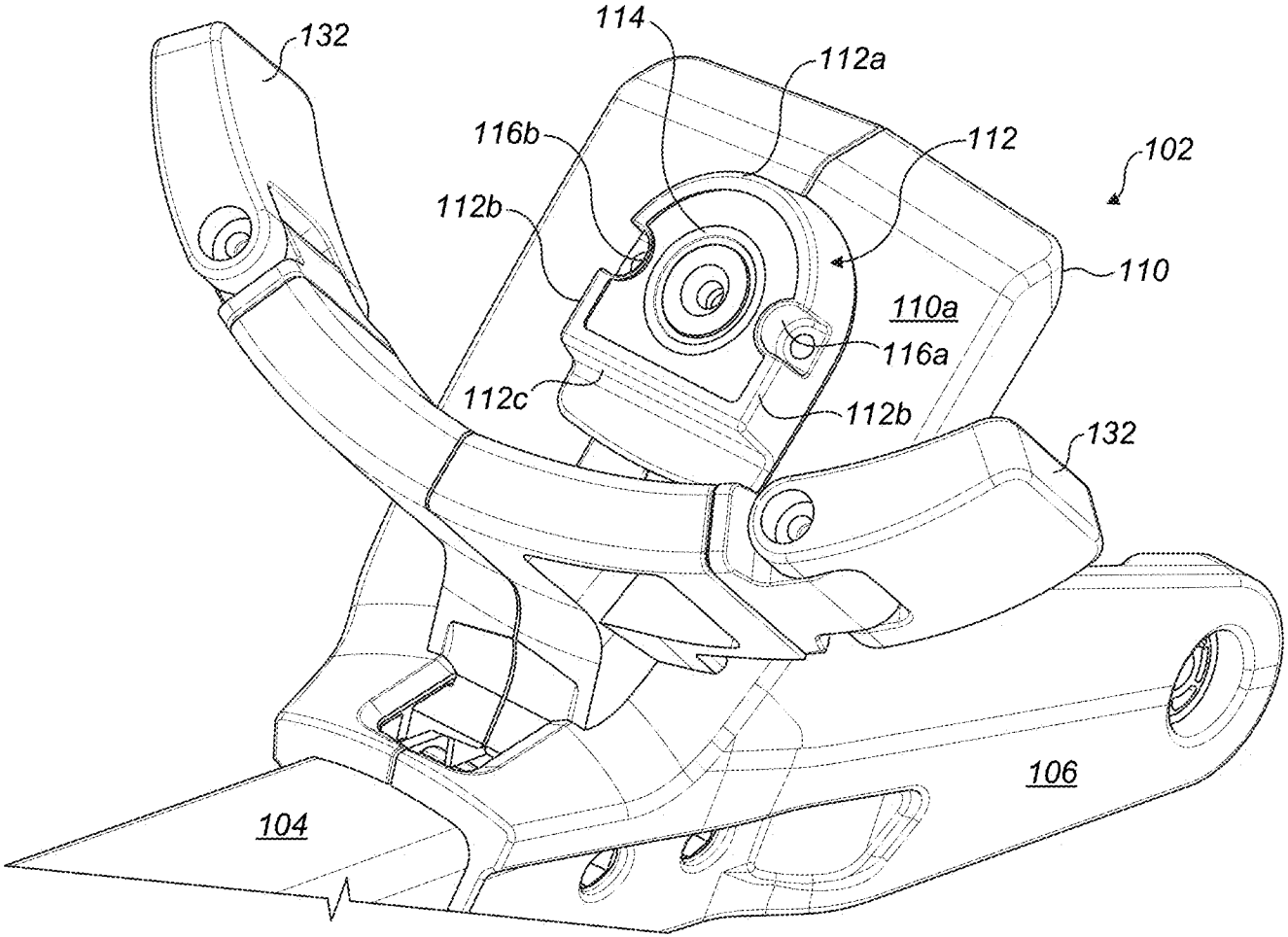
FIG. 4 shows a perspective view from above of a lower support member of a second embodiment of a golf trolley according to the first aspect of the invention.

FIG. 4 shows a lower portion 102 of a second embodiment of a golf trolley which in use transports a golf bag 118 (shown in FIGS. 5 to 8) around a golf course. The lower portion 102 of the golf trolley includes a front frame arm 104 which supports at its front end a front wheel assembly 106, which in turn rotatably supports a front wheel (not shown in FIG. 4). The front wheel assembly 106 defines a lower support member 110, which is in the form of a substantially rectangular base plate having a substantially planer upwardly facing surface 110*a*. The lower support member 110 has secured to it an upwardly projecting locating element 112. The locating element 112 comprises a curved front wall 112*a*, a pair of substantially straight side walls 112*b* which extend rearwards from each end of the front wall 112*a* and a substantially straight rear wall 112*c* which joins a rear portion of each of the two side walls 112*b*. Each of the side walls and the front wall 112*a* are inclined inwards from the base to the top of the locating element 112. The locating element 112 defines a recess extending downwards from its top surface within which is located a permanent magnet 114. The locating element 112 is fixed to the lower support member 110 by a pair of screws which extend through screw recesses 116*a*, 116*b* defined by the side walls 112*b* of the locating element 112. To provide additional support for the bottom of the golf bag 118, a curved support arm 132 extends upwards from the rear of the lower support member 110.

Figure 5:
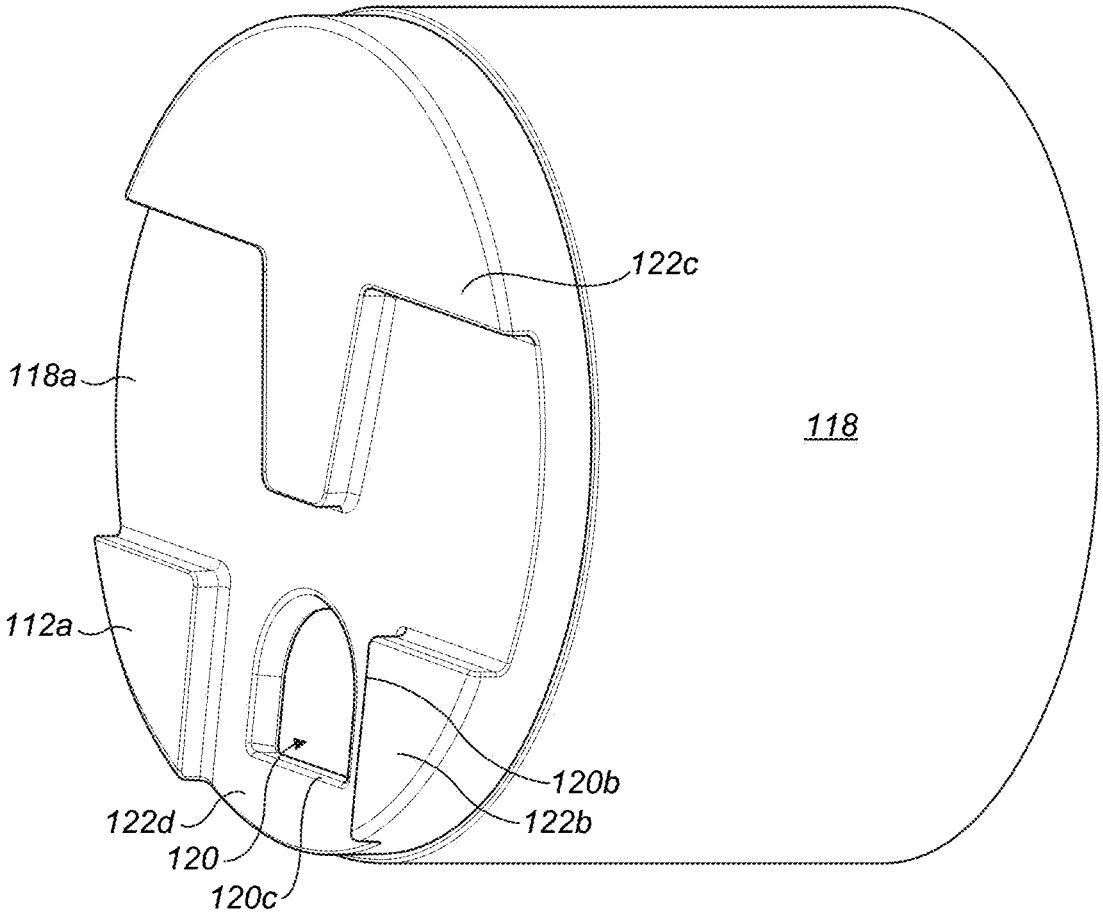
FIG. 5 shows a perspective view from below of a golf bag which forms part of a second embodiment of the second aspect of the invention.
Figure 6:
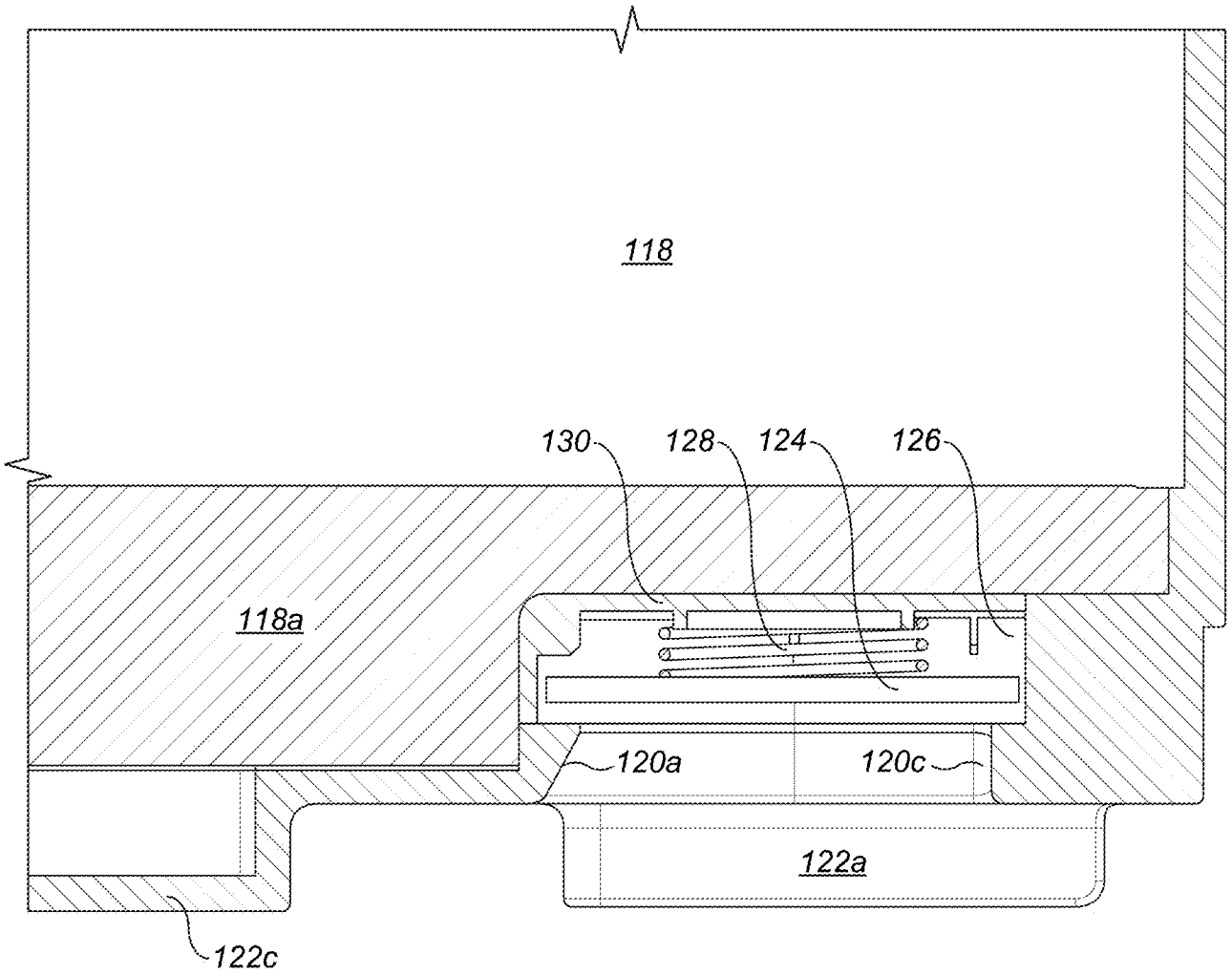
FIG. 6 shows a cross-sectional view through a base portion of the golf bag shown in FIG. 5.

FIGS. 5 and 6 show a base plate 118*a* of the golf bag 118. The base plate 118*a* defines towards a peripheral edge portion thereof a upwardly extending recess 120. The recess 120 is defined by a curved tapered front wall 120*a*, a pair of straight side walls 120*b* which extend rearwards from each end of the front wall 120*a* and a substantially straight rear wall 120*c* which joins a rear portion of each of the two side walls 120*b*. Each of the side walls 120*b* and the front wall 120*a* are tapered inwards such that the recess 120 is able to receive therein the locating element 112. The base plate 118*a* further includes three downwardly projecting feet elements 122*a*, 122*b*, 122*c* which define between them a recessed portion 122*d* of the golf bag base plate 118*a*. The upwardly extending recess 120 is defined between the feet portions 122*a* and 122*b*.

As shown in FIG. 6, a ferromagnetic plate 124 is located within a chamber 126 defined above the recess 120, where the recess 120 opens into the chamber 126. The diameter of the ferromagnetic plate 124 is greater than the respective diameters of the recess 120 (i.e., the gaps defined between the side walls 120*b*, the front wall 120*a* and the rear wall 120*c*) such that the plate 124 is not able to exit the chamber 126 via the recess 120. In other words, the ferromagnetic plate 124 is captive within the chamber 126. However, the plate 124 is capable of moving within two orthogonal planes within the chamber 126. The ferromagnetic plate 124 is biased towards the top of the recess walls 120*a*, 120*b*, 120*c* by a spring 128 which is engaged with a top wall 130 of the chamber 126.

Figure 7:
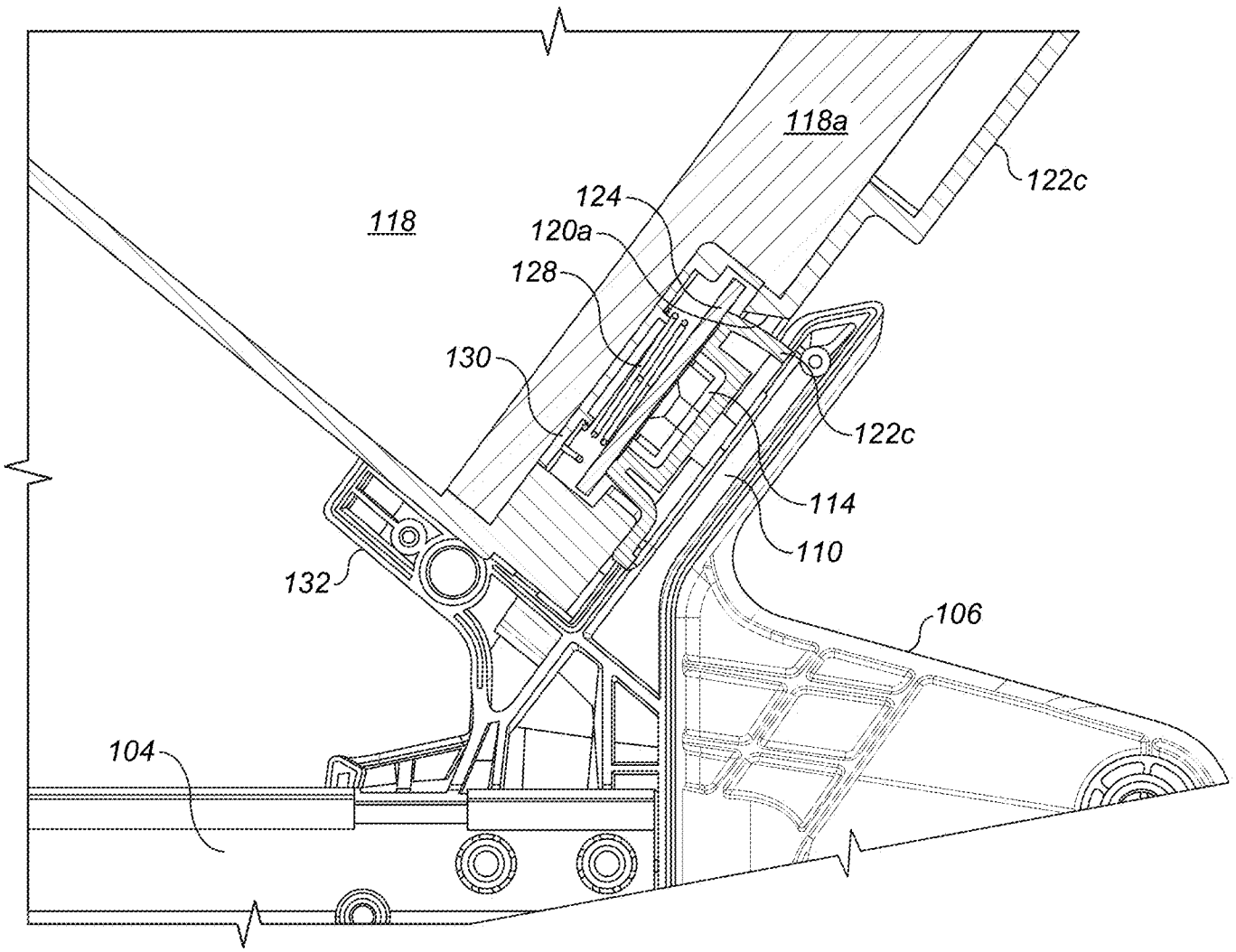
FIG. 7 shows a cross-sectional view through the base portion of the golf bag shown in FIG. 6 when magnetically coupled to the lower support member shown in FIG. 4.
Figure 8:
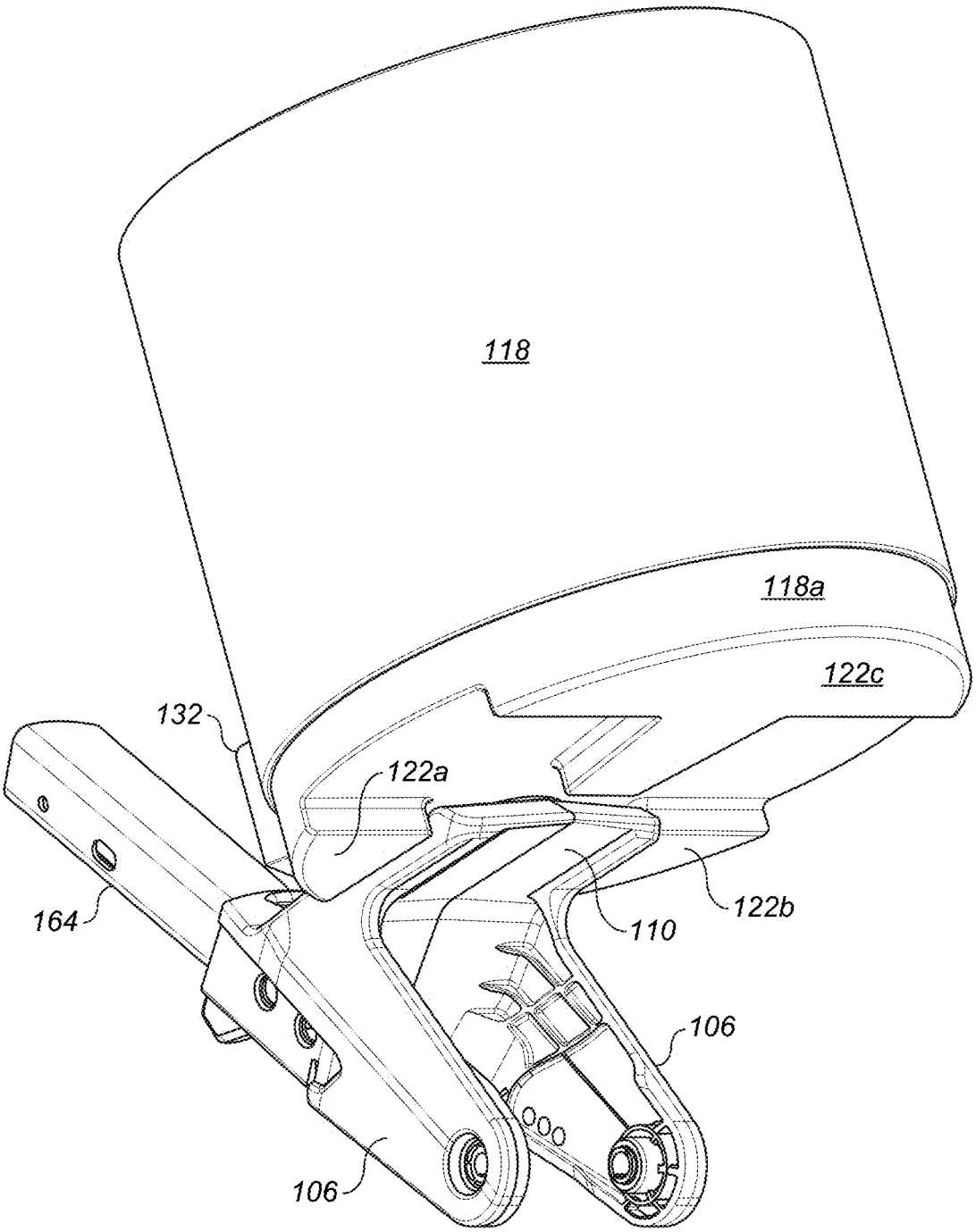
FIG. 8 shows a perspective view of the combination of the golf bag and lower support member shown in FIG. 7.

FIGS. 7 and 8 show a golf bag 118 supported by a lower portion 102 of a golf trolley. As can be seen in FIG. 7, the height of the upwardly projecting locating element 112 (i.e. the distance from the base of the locating element 112 to the top of the locating element 112) is greater than the depth of the recess (i.e. the distance from the lower end of the walls 120 to the upper end of the walls 120), such that an upper portion of the locating element 112 projects into the chamber 126. In doing this, the top surface of the locating element 112 urges the ferromagnetic plate 124 towards the top wall 130 of the chamber 126 against the biasing force of the spring 128. This creates an intimate contact between the top surface of the locating element 112 and the ferromagnetic plate 124, which in turn maximises the magnetic attractive force between the permanent magnet 114 and the ferromagnetic plate 124.

The combination of the magnetic coupling between the recess defined by the base plate 118*a* of the golf bag 118 and the permanent magnet carried within the upwardly projecting locating element 112 of the lower support member 110, and the curved support arm 132 properly secures a bottom portion of the golf bag 118 to the lower portion 102 of the golf trolley.

Figure 9:
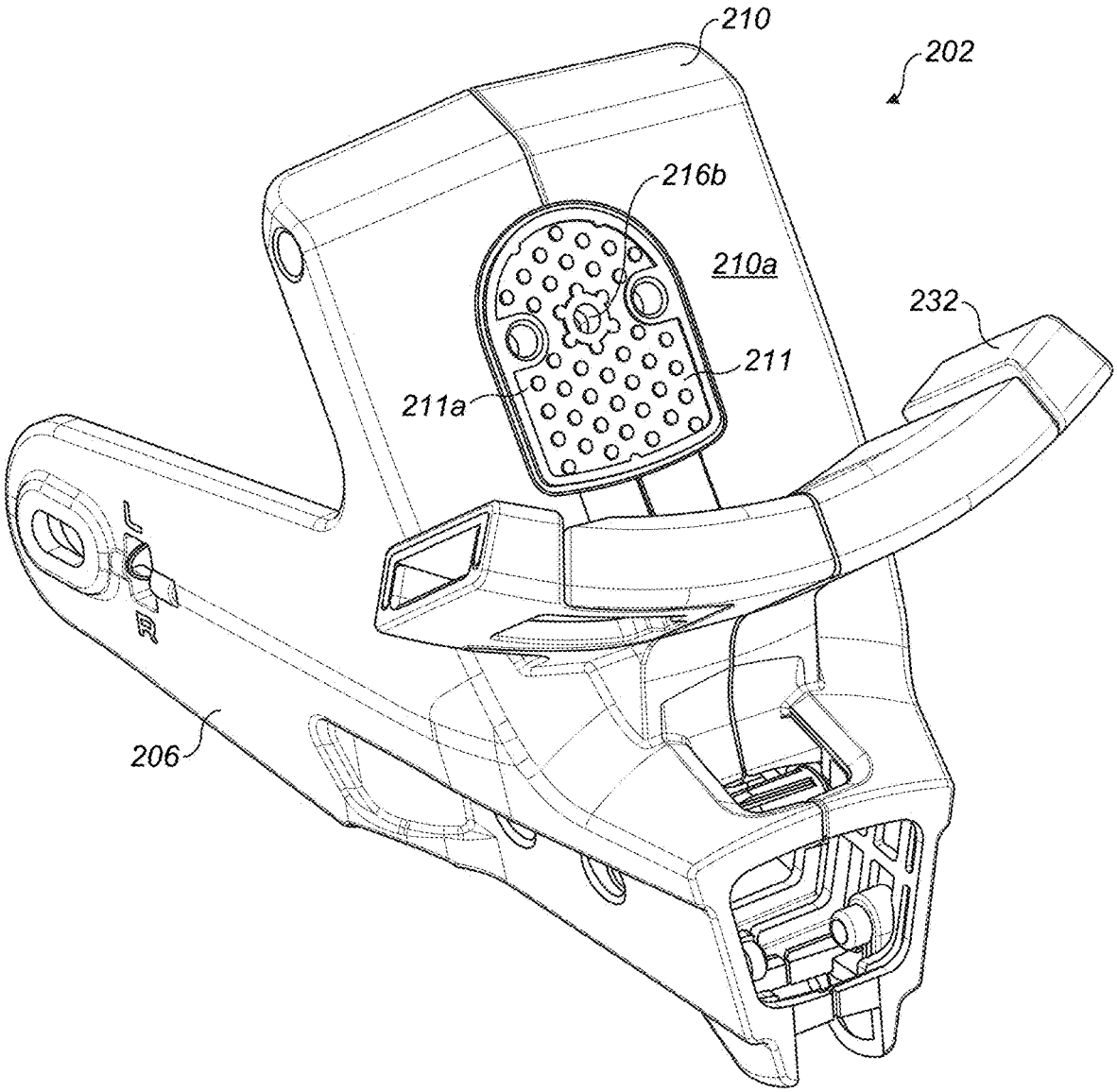
FIG. 9 shows a perspective view from above of a lower support member of a third embodiment of a golf trolley according to the first aspect of the invention.
Figure 10:
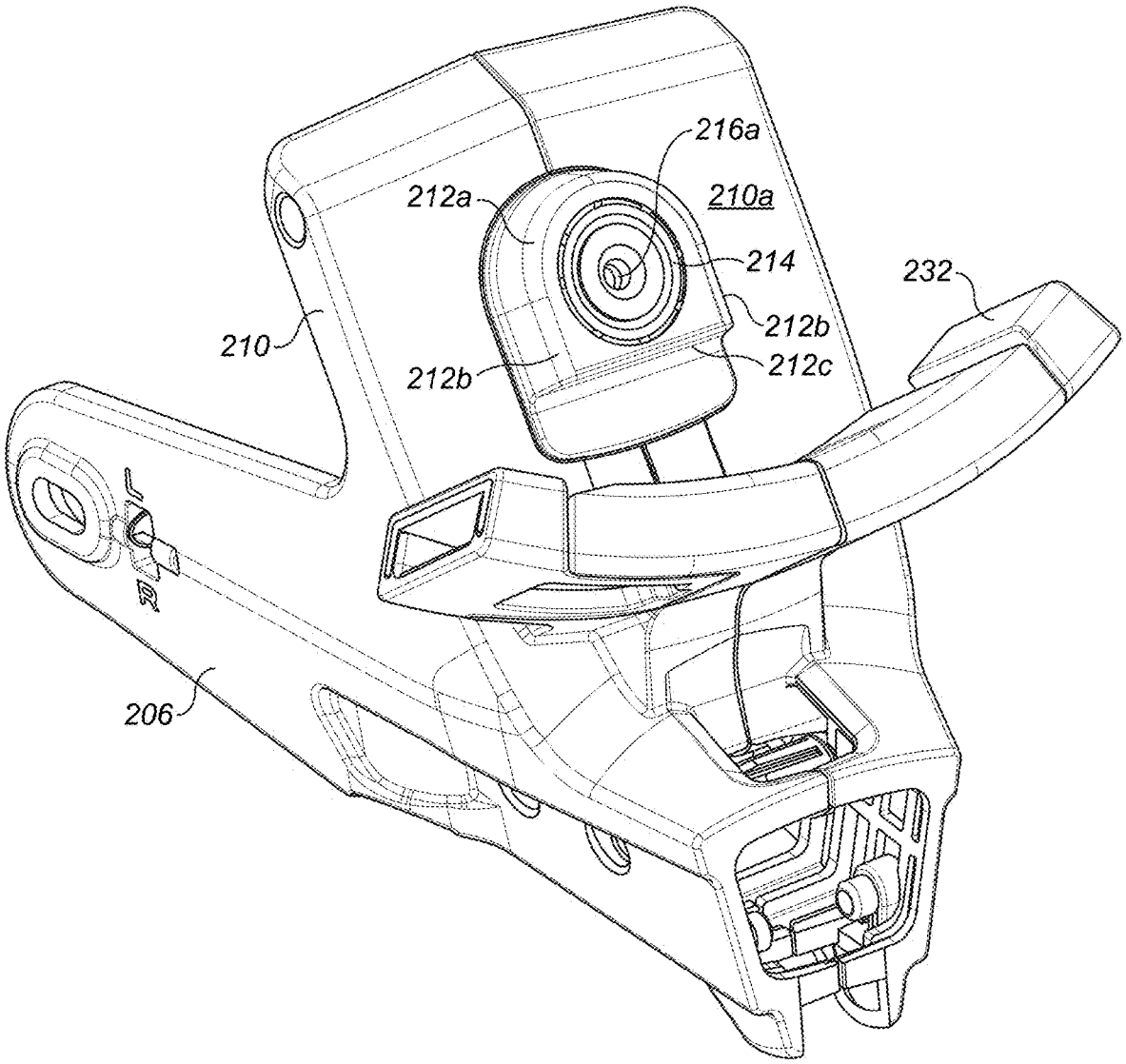
FIG. 10 shows a locating element secured to the base plate shown in FIG. 9.
Figure 11:
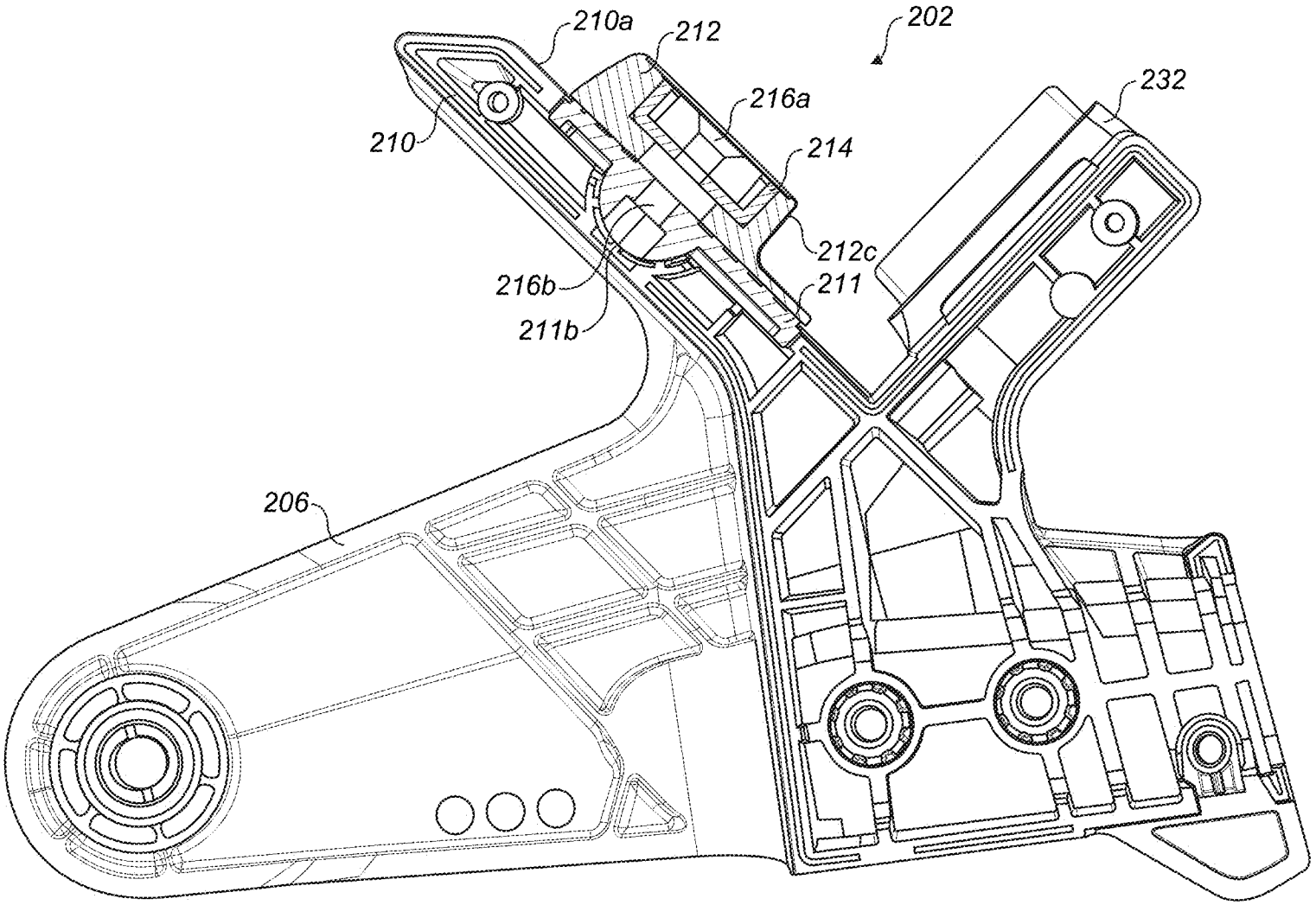
FIG. 11 shows a cross-sectional view through the lower support member shown in FIG. 10.

FIGS. 9 to 11 show a lower portion 202 of a third embodiment of a golf trolley which in use transports a golf bag 218 (shown in FIGS. 12 and 13) around a golf course. The lower portion 202 of the golf trolley includes a front wheel assembly 206, which in turn rotatably supports a front wheel (not shown in FIGS. 9 to 11). The front wheel assembly 206 defines a lower support member 210, which is in the form of a substantially rectangular base plate having a substantially planer upwardly facing surface 210*a*. The lower support member 210 has secured to it a magnet support plate 211. As shown in FIG. 11, the magnet support plate 211 includes a substantially planar upwardly facing surface 211*a* and a downwardly facing curved pivot portion 211*b*. The curved pivot portion 211*b* is engaged within a correspondingly shaped recess defined by the lower support member 210 and acts as a pivot, whereby the magnet support plate 211 is able to rotate about the curved pivot portion 211*b* relative to the lower support member 210. The degree of rotation permitted by this arrangement is constrained such that the substantially planar upper surface 211*a* rotates relative to the planar surface 210*a* of the lower support member 210 by a pre-determined angle, for example ±10°. As noted above, the ability of the magnet support plate 211 to rotate relative to the lower support member 210 allows for a more accurate engagement of the two components which together form a magnetic coupling.

FIGS. 10 and 11 show the lower portion 202 of the golf trolley shown in FIG. 9, but with the addition of an upwardly projecting locating element 212 secured to the magnet support plate 211. The locating element 212 comprises a curved front wall 212*a*, a pair of substantially straight side walls 212*b* which extend rearwards from each end of the front wall 212*a* and a substantially straight rear wall 212*c* which joins a rear portion of each of the two side walls 212*b*. Each of the side walls 212*b* and the front wall 212*a* are inclined inwards from the base to the top of the locating element 212. The locating element 212 defines a recess extending downwards from its top surface within which is located a permanent magnet 214. The locating element 212 is fixed to the magnet support plate 211 by a screw which extends through a screw recess 216*a* defined by the locating element 212 and is threadedly engaged with a threaded receiver 216*b* carried by the magnet support plate 211. To provide additional support for the bottom of the golf bag 218, a curved support arm 232 extends upwards from the rear of the lower support member 210.

Figure 12:
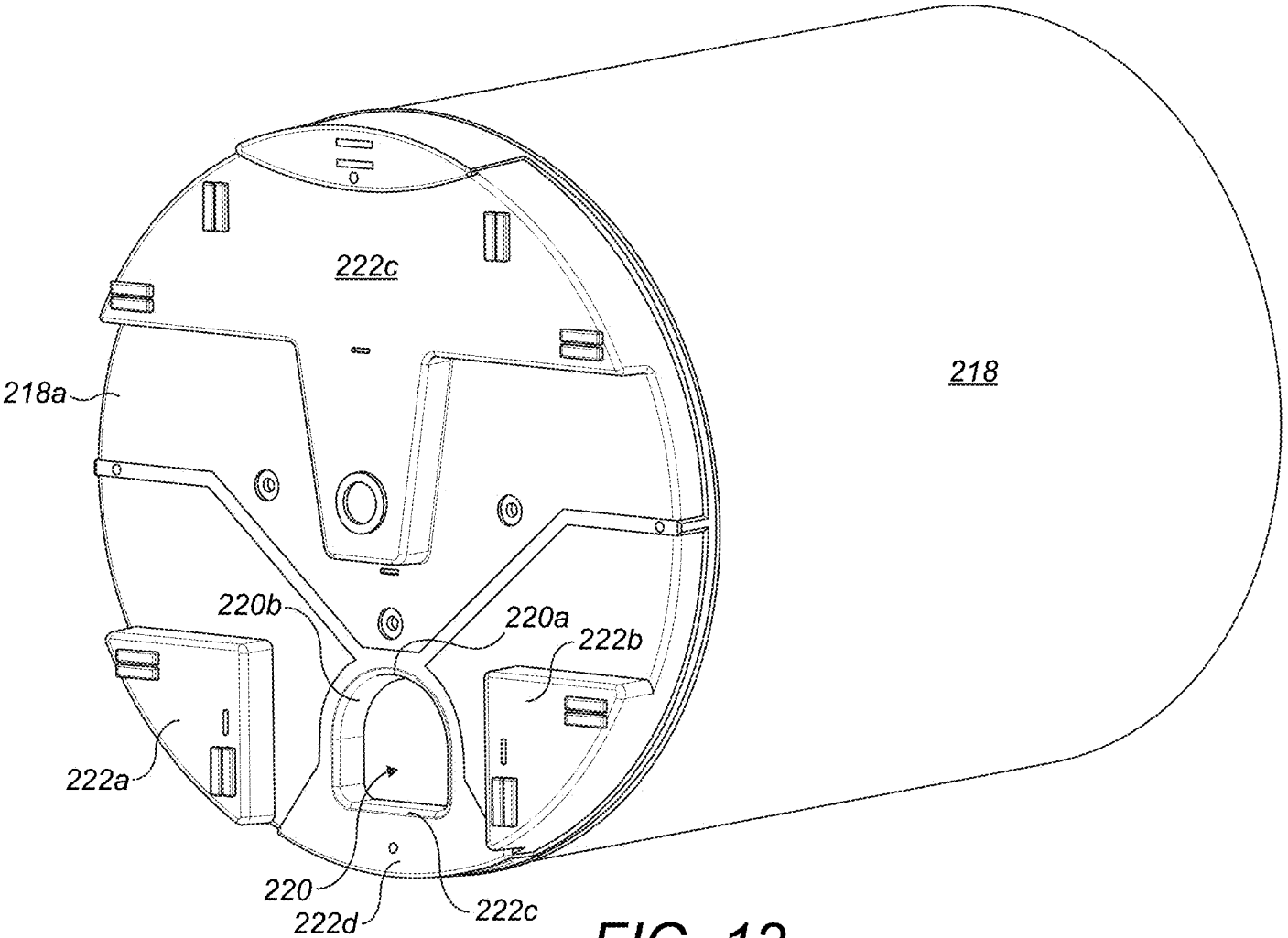
FIG. 12 shows a perspective view from below of a golf bag which forms part of a third embodiment of the second aspect of the invention.

FIG. 12 shows a base plate 218*a* of the golf bag 218. The base plate 218*a* defines towards a peripheral edge portion thereof a upwardly extending recess 220. The recess 220 is defined by a curved tapered front wall 220*a*, a pair of straight side walls 220*b* which extend rearwards from each end of the front wall 220*a* and a substantially straight rear wall 220*c* which joins a rear portion of each of the two side walls 220*b*. Each of the side walls 220*b* and the front wall 220*a* are tapered inwards such that the recess 220 is able to receive therein the locating element 212. The base plate 218*a* further includes three downwardly projecting feet elements 222*a*, 222*b*, 222*c* which define between them a recessed portion 222*d* of the golf bag base plate 218*a*. The upwardly extending recess 220 is defined between the feet portions 222*a* and 222*b*.

Figure 13:
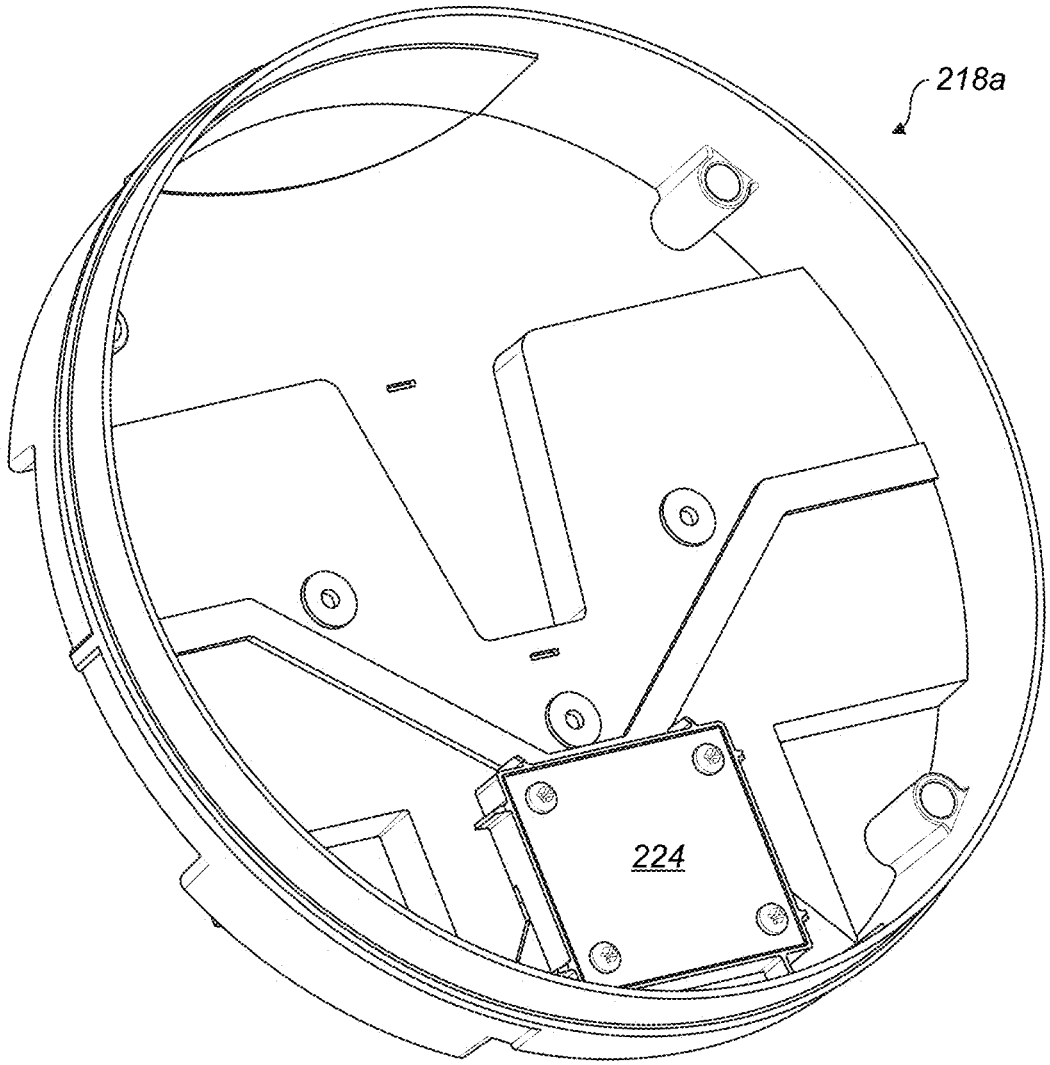
FIG. 13 shows a perspective view from inside of a base plate of the golf bag shown in FIG. 12.

As shown in FIG. 13, the upwardly extending recess 220 terminates at a simple ferromagnetic plate 224, which is fixed to the golf bag base plate 218*a* by four screws. Unlike the ferromagnetic plate 124 described above in connection with the second embodiment of the invention, the ferromagnetic plate 224 is fixed relative to the golf bag base plate 218*a*.

Figure 14:
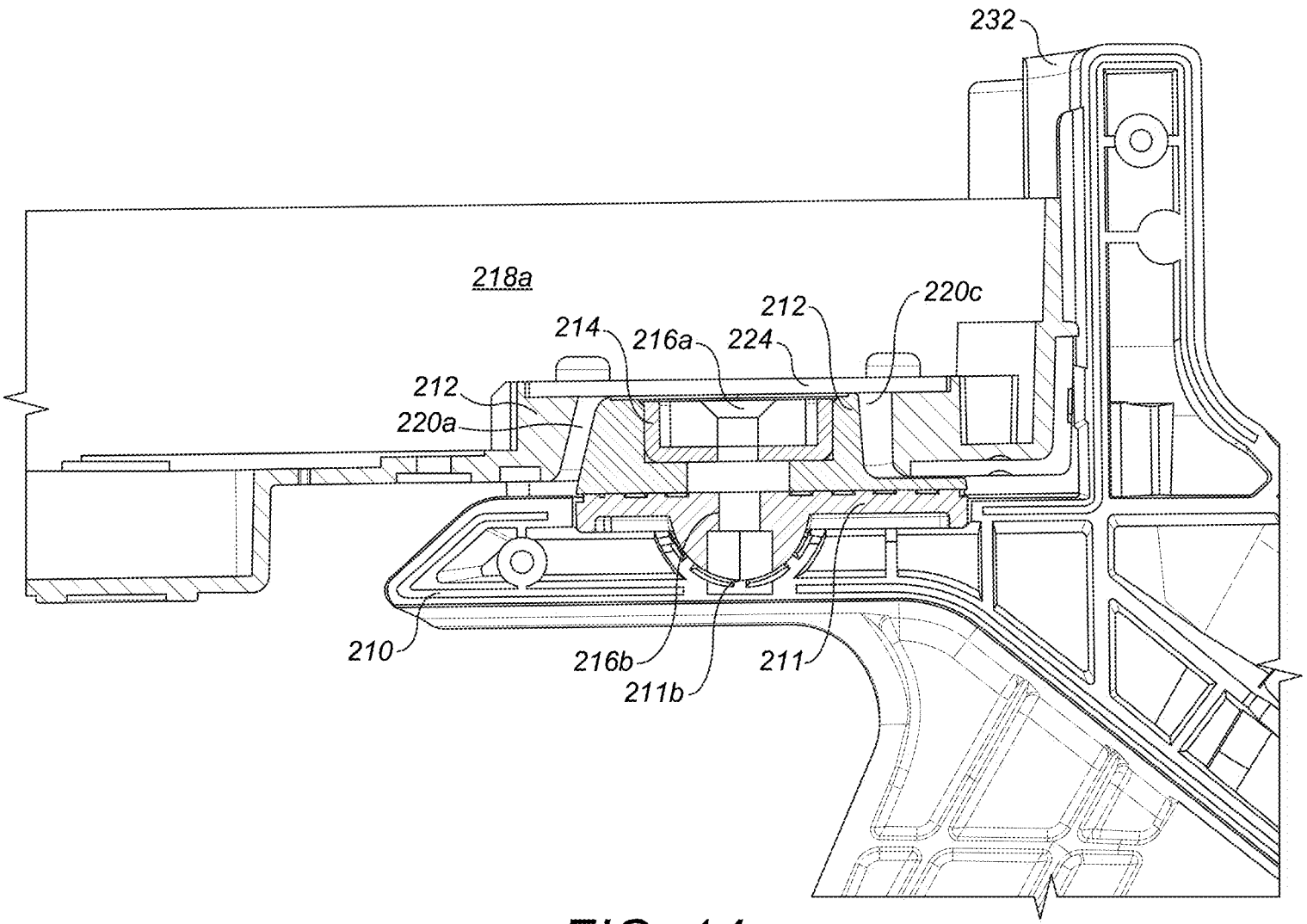
FIG. 14 shows a cross-sectional view through the base portion of the golf bag shown in FIG. 12 when magnetically coupled to the lower support member shown in FIG. 10.

FIG. 14 shows the golf bag base plate 218*a* supported by the lower support member 210, with the upwardly extending locating element 212 disposed within the recess 220 and the permanent magnet 214 magnetically coupled to the ferromagnetic plate 224.

The invention claimed is:

1. A combination of a golf vehicle and a golf bag, wherein the golf vehicle includes a golf bag support; wherein the golf vehicle is selected from a golf trolley and a golf cart; wherein the golf bag support includes a lower support member; wherein the lower support member includes an upwardly projecting locating member; wherein the upwardly projecting locating member comprises a permanent magnet; wherein the upwardly projecting locating member tapers from a lower portion to an upper portion; wherein the locating member defines a proximal portion which is adjacent to the lower support member and defines a distal portion which is spaced from the lower support member; wherein the distal portion carries therein the permanent magnet; wherein the golf bag support further includes a support arm which extends upwardly from the lower support member; wherein the golf bag includes a bag base plate; the bag base plate defines an upwardly extending recess defined by a recess body portion, the recess receives therein the upwardly projecting locating member, and the recess body portion which defines the upwardly extending recess includes a ferromagnetic element in the form of a ferromagnetic plate; wherein the golf bag base plate defines a chamber above the recess, wherein the recess opens into the chamber, and the ferromagnetic plate is disposed within the chamber; and wherein the ferromagnetic plate is biased towards the recess along a bias axis, and a first cross-sectional dimension of the recess measured along a first plane normal to the bias axis is smaller than a second cross-sectional dimension of the ferromagnetic plate measured along a second plane that is normal to the bias axis and parallel to the first plane.

2. The combination according to claim 1, wherein the ferromagnetic plate is permitted to move in two orthogonal planes within the chamber.

* * * * *